US006979031B2

(12) United States Patent
Coppotelli et al.

(10) Patent No.: US 6,979,031 B2
(45) Date of Patent: Dec. 27, 2005

(54) PORTABLE DEVICE FOR HOLDING A LIQUID CONTAINER

(76) Inventors: Benedict Coppotelli, 9400 Empire Rock St., Las Vegas, NV (US) 89143; Staci Joi Coppotelli, 9400 Empire Rock St., Las Vegas, NV (US) 89143

( * ) Notice: Subject to any disclaimer, the term of this patent is extended or adjusted under 35 U.S.C. 154(b) by 200 days.

(21) Appl. No.: 10/404,030

(22) Filed: Apr. 2, 2003

(65) Prior Publication Data

US 2004/0195849 A1 Oct. 7, 2004

(51) Int. Cl.[7] ..... B65D 23/10
(52) U.S. Cl. ..... 294/27.1; 294/33; 215/396; 16/425
(58) Field of Search ..... 294/27.1, 31.2, 294/32, 33; 215/395, 396; 220/757, 758, 220/759; 16/422, 425

(56) References Cited

U.S. PATENT DOCUMENTS 1,584,857 A * 5/1926 Hobbs ..... 215/395
2,029,051 A * 1/1936 Blevins ..... 294/33
2,463,651 A * 3/1949 Stevens ..... 215/395
D186,555 S * 11/1959 Hunt ..... D7/622
D188,706 S * 8/1960 Sircovics ..... D7/622
2,958,444 A * 11/1960 Rhoe ..... 222/183
2,961,121 A * 11/1960 Bergey ..... 220/741
3,488,078 A * 1/1970 Cooperstein ..... 294/31.2
4,120,073 A * 10/1978 Studebaker ..... 294/33
4,723,801 A * 2/1988 Musumeci et al. ..... 294/33
4,842,158 A * 6/1989 Reyes, Jr. ..... 222/470
5,013,074 A * 5/1991 Galle ..... 294/33
D343,094 S * 1/1994 Varney ..... D7/622

* cited by examiner

*Primary Examiner*—Dean J. Kramer
(74) *Attorney, Agent, or Firm*—Veronica-Adele R. Cao; Craig Weiss; Weiss, Moy & Harris, P.C.

(57) ABSTRACT

A portable device for holding a liquid container, comprising a substantially rigid vertical handle manually graspable by a user, a substantially rigid top container gripping member extending horizontally from the upper end of the vertical handle, a substantially rigid bottom container gripping member or base member extending horizontally from the lower end of the vertical handle, and an attachable container gripping member to provide additional support, if desired, wherein the top container gripping member, the bottom container gripping member or base container holding member and the attachable container gripping member are identically oriented.

5 Claims, 2 Drawing Sheets

PORTABLE DEVICE FOR HOLDING A LIQUID CONTAINER

FIELD OF THE INVENTION

This invention relates generally to container holding devices, and more specifically, to a device for holding a liquid container having the characteristics of portability, durability, adaptability and ease of use.

BACKGROUND OF THE INVENTION

Today, most beverages or liquids for consumer use are contained in a bottle, can or carton. These containers vary in size and shape.

In order to pour the liquid from its container, one must grasp the bottle, can or carton and tilt it. It is somewhat difficult to tilt these containers because they do not have a handle for the user to grasp.

An even greater difficulty arises when the container is too heavy or too large. Without a handle, the user is usually required to use two hands to tilt the bottle or carton. This can become awkward as the user is unable to simultaneously hold another object, such as the cup into which the user is pouring the liquid. If the user is unable to maintain a firm grasp on the container, the user will pour the liquid inaccurately and uncontrollably, causing the liquid to spill. Furthermore, if the user is unable to hold the cup, it may topple as the liquid is being poured into it.

A number of bottle holders are already in existence. U.S. Pat. No. 5,025,940 describes a strap member that serves as a handle. However, this strap is thin and highly flexible. The lack of rigidity compromises the amount of control that the user has over the container as it is tilted. Furthermore, the instability of the strap may cause the base member to slip off of the bottom of the bottle as it is tilted, causing spillage.

Another patent, U.S. Pat. No. 4,660,876, discloses a bottle holder with two gripping members oriented in opposite directions. In order to remove the bottle, the user must first remove one gripping member and then remove the other. This process may prove to be awkward. Furthermore, while one gripping member is being removed, the other attached gripping member must sustain a substantial amount of torque. If the user is not careful, this process may cause the gripping member to break off.

U.S. Pat. No. 4,666,197 discloses a bottle holder having an upper gripping member that fits over the bottle flange. This gripping member, however, may be applied only after removing the cap. This may lead to spillage while the user is attempting to fit the gripping member over the bottle mouth and over the flange.

None of the aforementioned patents are capable of being used with a carton container. Furthermore, none of the above patents disclose a handle having a finger gripping configuration for providing a firm grasp by the user.

Therefore, a need existed for a portable and durable device for holding either a round bottle container or a carton container comprising a substantially rigid handle having a finger gripping configuration for providing a firm grasp by the user and identically oriented container gripping members that may be rapidly attached and removed while the container remains either open or closed.

SUMMARY OF THE INVENTION

An object of the present invention is to provide a portable and durable device for holding a small bottle comprising a substantially rigid handle having a finger gripping configuration for providing a firm grasp by the user and identically oriented container gripping members that may be rapidly attached and removed while the container remains either open or closed.

Another object of the present invention is to provide a portable and durable device for holding a large i.e. two liter bottle comprising a substantially rigid handle having a finger gripping configuration for providing a firm grasp by the user, identically oriented gripping members that may be attached and removed while the container remains closed, and an attachable gripping member to provide more support if desired.

Yet another object of the present invention is to provide a portable and durable device for holding a carton comprising a substantially rigid handle having a finger gripping configuration for providing a firm grasp by the user, a top gripping member, and an identically oriented base member for receiving and supporting the bottom of the carton.

BRIEF DESCRIPTION OF THE PREFERRED EMBODIMENTS

In accordance with one embodiment of the present invention, a portable device for holding a liquid container is disclosed, comprising, a substantially rigid vertical handle manually graspable by a user, the vertical handle having an upper end, a lower end and a finger gripping configuration for providing a firm grasp by the user, a substantially rigid top container gripping member extending horizontally from the upper end of the vertical handle, the top container gripping member being substantially C-shaped, a substantially rigid bottom container gripping member extending horizontally from the lower end of the vertical handle, the bottom container gripping member being substantially C-shaped, and a third substantially rigid attachable container gripping member extending horizontally for providing additional container holding support, the attachable gripping member being substantially C-shaped.

In accordance with yet another embodiment of the present invention, a portable device for holding a liquid container is disclosed, comprising, a substantially rigid vertical handle manually graspable by a user, the vertical handle having an upper end, a lower end and a finger gripping configuration for providing a firm grasp by the user, a substantially rigid top container gripping member extending horizontally from the upper end of the vertical handle, the top container gripping member being substantially C-shaped, and a substantially rigid bottom container gripping member extending horizontally from the lower end of the vertical handle, the bottom container gripping member being substantially C-shaped, and a third substantially rigid attachable container gripping member extending horizontally for providing additional container holding support, the attachable gripping member being substantially C-shaped.

In accordance with yet another embodiment of the present invention, a portable device for holding a liquid container is disclosed, comprising, a substantially rigid vertical handle manually graspable by a user, the vertical handle having an upper end, a lower end and a finger gripping configuration for providing a firm grasp by the user, a substantially rigid top container gripping member extending horizontally from the upper end of the vertical handle, the top container gripping member being substantially square-shaped, and a substantially rigid base member extending horizontally from the lower end of the vertical handle, the base member having a substantially square perimeter and a bottom surface.

The foregoing and other objects, features, and advantages of the invention will be apparent from the following, more detailed description of the preferred embodiments of the invention, as illustrated in the accompanying drawings.

DETAILED DESCRIPTION OF THE PREFERRED EMBODIMENTS

Figure 1:
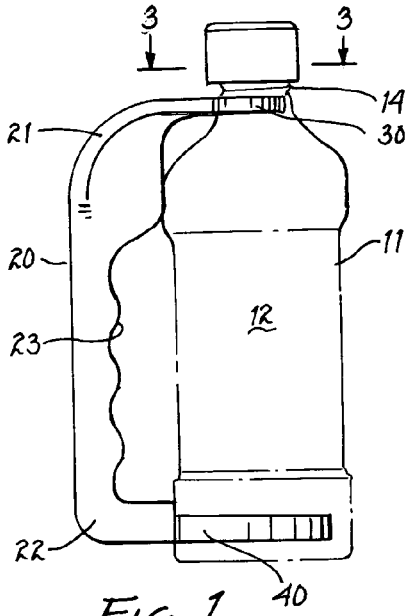
FIG. 1 is a side elevational view of a first embodiment of the container gripping device of the present invention, shown coupled to a 1 Liter bottle.
Figure 2:
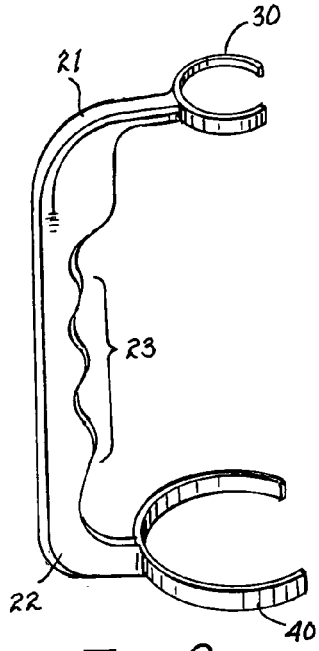
FIG. 2 is a perspective view of the top container gripping device of FIG. 1.

FIG. 1 and FIG. 2 show a portable device 10 for holding a liquid container 11 such as a small 1 Liter bottle having a cylindrical body 12 and a narrow neck 13 with an annular flange 14. The device 10 comprises a substantially rigid vertical handle 20. The vertical handle 20 has an upper end 21, a lower end 22, and a finger gripping configuration 23 for providing the user with a firm grasp of the device 10. The device 10 also has a substantially rigid top gripping member 30 extending horizontally from the upper end 21 of the vertical handle 20. The top container gripping member 30 is substantially C-shaped and sized to engage the neck 13 of the bottle 11 directly under the annular flange 14. The device 10 also has a substantially rigid bottom container gripping member 40 extending horizontally from the lower end 22 of the vertical handle 20. The bottom container gripping member 40 is substantially C-shaped and sized to engage the cylindrical body 12 of the bottle 11. As shown, the top container gripping member 30 and the bottom container gripping member 40 are identically oriented in the same direction.

Figure 4:
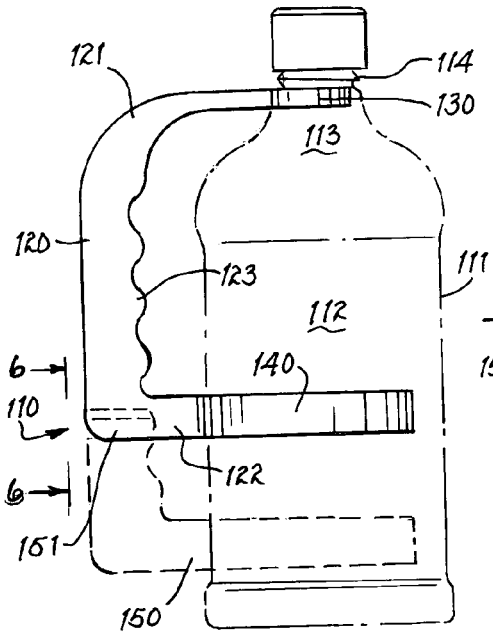
FIG. 4 is a side view of a second embodiment of the container gripping device of the present invention, shown coupled to a 2 Liter bottle and shown with an additional attachable container gripping member, if needed, in phantom lines.
Figure 5:
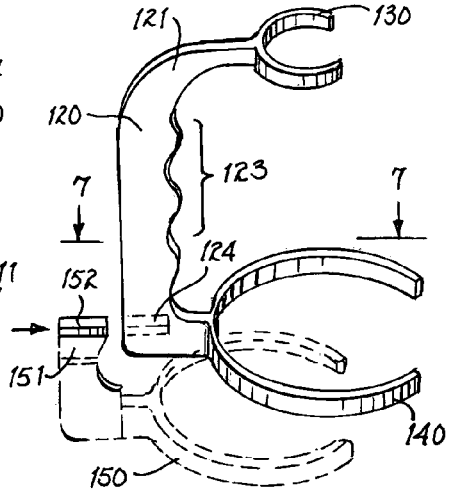
FIG. 5 is a perspective view of the container gripping device of FIG. 4, shown with the attachable container gripping member in phantom lines separated from the remainder portion of the device.

FIG. 4 and FIG. 5 show a portable device 110 for holding a liquid container 111 such as a large 2 Liter bottom having a cylindrical body 112 and a narrow neck 113 with an annular flange 114. The device 110 comprises a substantially rigid vertical handle 120. The vertical handle 120 has an upper end 121, a lower end 122, and a finger gripping configuration 123 for providing the user with a firm grasp of the device 110. The device 110 also has a substantially rigid top container gripping member 130 extending horizontally from the upper end 121 of the vertical handle 120. The top container gripping member 130 is substantially C-shaped and sized to engage the neck 113 of the bottle 111 directly under the annular flange 114. The device 110 also has a substantially rigid bottom container gripping member 140 extending horizontally from the lower end 122 of the vertical handle 120. The bottom container gripping member 140 is substantially C-shaped and sized to engage the cylindrical body 112 of the bottle 111. These figures also depict a substantially rigid attachable container gripping member 150 extending horizontally for providing additional support if desired. The attachable container gripping member 150 is substantially C-shaped and sized to engage the cylindrical body 112 of the bottle 111. The attachable container gripping member 150 also has a connection end 151 extending upward for attaching to the lower end 122 of the vertical handle 120. The connection end 151 also has a ridged edge 152 (see FIG. 5). The lower end 122 of the vertical handle 120 has a slot 124 for receiving the corresponding ridged edge 152 in a tongue-and-groove type connection 154. Other types of connections can be used, if desired. As shown, the top container gripping member 130, the bottom container gripping member 140, and the attachable container gripping member 150 are identically oriented in the same direction.

Figure 3:
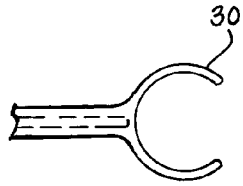
FIG. 3 is a top view of the top container gripping member of the container gripping device of FIG. 1, taken along line 3—3 of FIG. 1.
Figure 3A:
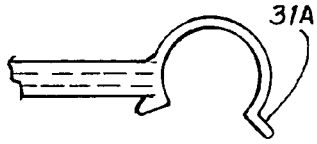
FIG. 3A is a top view of an alternate embodiment of the top container gripping member of FIG. 3.

FIG. 3 depicts one embodiment of the top container gripping member 30. And FIG. 3A shows an alternate embodiment of the top container gripping member 30A, wherein the substantially C-shaped top container gripping member 30A has a flat extension end portion on which the user may push to aid in removal of the device the top gripping member 30A from the container.

Figure 6:
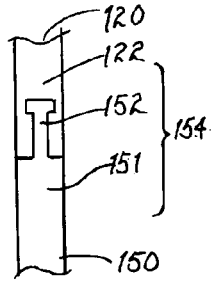
FIG. 6 is a view of the tongue-and-groove connection of the device of FIG. 4, taken along line 6—6 of FIG. 4.

FIG. 6 illustrates the slot 124 on the lower end 122 of the vertical handle 120. It also shows the corresponding ridged edge 152 on the connection end 151 of the attachable container gripping member 150. The ridged edge 152 and the slot 124 are preferably shown to be combined in a tongue-and-groove connection 154.

Figure 7:
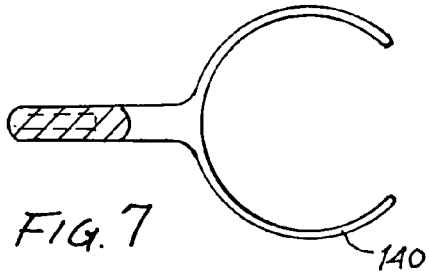
FIG. 7 is a top view of the bottom container gripping member of FIG. 5 taken along line 7—7 of FIG. 5.

FIG. 7 shows the bottom container gripping member 140.

Figure 8:
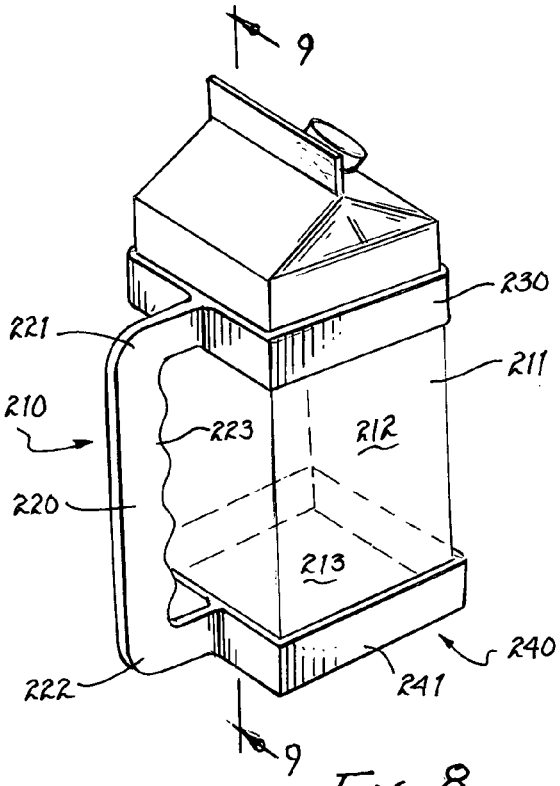
FIG. 8 is a perspective view of a third embodiment of the container gripping device of the present invention, shown coupled to a carton.
Figure 9:
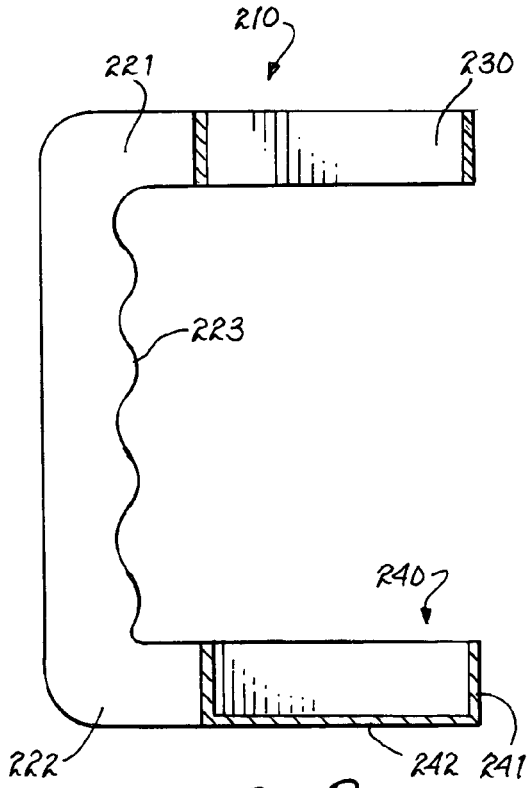
FIG. 9 is a side cross-sectional view of the device of FIG. 8, taken along line 9—9 of FIG. 8.

FIG. 8 and FIG. 9 show a portable device 210 for holding a liquid container 211 such as a carton 211 having a substantially rectangular body 212 and a substantially square bottom 213. The device 210 comprises a substantially rigid vertical handle 220. The vertical handle 220 has an upper end 221, a lower end 222, and a finger gripping configuration 223 for providing the user with a firm grasp of the device 210. The device 210 also has a substantially rigid top container gripping member 230 extending horizontally from the upper end 221 of the vertical handle 220. The top container gripping member 230 is substantially square-shaped and sized to engage the substantially rectangular body 212 of the carton 211. The device 210 also has a substantially rigid base member 240 extending horizontally from the lower end 222 of the vertical handle 220. The base member 240 has a substantially square perimeter 241 and a bottom surface 242 (see FIG. 10). The base member 240 is shaped to receive and support the bottom 213 of the carton 211. As shown, the top container gripping member 230 and the base member 240 are identically oriented in the same direction. To use the device 210, a carton 211 is passed through the top container gripping member 230 and received into the base member 240 so as to securely hold the carton 211 as it is tilted.

Figure 10:
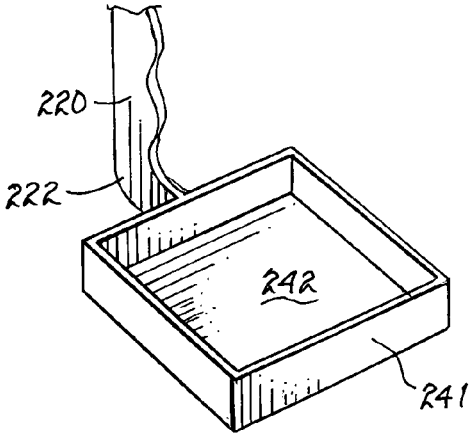
FIG. 10 is a perspective view of the base member of the device of FIG. 8.

FIG. 10 shows a raised portion 241 of the base member 240 and the bottom surface 242 of the base member 240.

While the invention has been particularly shown and described with reference to preferred embodiments thereof, it will be understood by those skilled in the art that the foregoing and other changes in form and detail may be made therein without departing from the spirit and scope of the invention.

We claim:

1. A portable device for holding a liquid container comprising:

a substantially rigid vertical handle manually graspable by a user, the vertical handle having an upper end, a lower end and a finger gripping configuration for providing a firm grasp by the user;

a first substantially rigid top container gripping member extending horizontally from the upper end of the vertical handle, the top container gripping member being substantially C-shaped;

a second substantially rigid bottom container gripping member extending horizontally from the lower end of the vertical handle, the bottom container griping member being substantially C-shaped; and a third substantially rigid attachable container gripping member extending horizontally for providing additional container holding support, the third attachable container gripping member being substantially C-shaped and comprising a connection end extending upward for attaching to the lower end of the vertical handle.

2. The device of claim 1 wherein the connection end further comprises a ridged edge.

3. The device of claim 1 wherein the lower end of the vertical handle further comprises a slot for receiving the corresponding ridged edge of the connection end in a tongue-and-groove connection.

4. A portable device for holding a liquid container comprising:

a substantially rigid vertical handle manually graspable by a user, the vertical handle having an upper end, a lower end and a finger gripping configuration for providing a firm grasp by the user;

a first substantially rigid top container gripping member extending horizontally from the upper end of the vertical handle, the top container gripping member being substantially C-shaped;

a second substantially rigid bottom container gripping member extending horizontally from the lower end of the vertical handle, the bottom container griping member being substantially C-shaped; and a third substantially rigid attachable container gripping member extending horizontally for providing additional container holding support, the third attachable container gripping member being substantially C-shaped and wherein the first top container gripping member, the second bottom gripping member, and the third attachable gripping member are identically oriented.

5. A portable device for holding a liquid container comprising:

a substantially rigid vertical handle manually graspable by a user, the vertical handle having an upper end, a lower end and a finger gripping coni.guration for providing a firm grasp by the user;

a first substantially rigid top container gripping member extending horizontally from the upper end of the vertical handle, the top container gripping member being substantially C-shaped and comprising a substantially flat end portion on which the user may push to aid in removal of the device;

a second substantially rigid bottom container gripping member extending horizontally from the lower end of the vertical handle, the bottom container griping member being substantially C-shaped; and a third substantially rigid attachable container gripping member extending horizontally for providing additional container holding support, the third attachable container gripping member being substantially C-shaped.

* * * * *